US011619038B2

(12) United States Patent
Sherwood

(10) Patent No.: US 11,619,038 B2
(45) Date of Patent: Apr. 4, 2023

(54) TURF COVER FOR A WATER DRAINAGE SYSTEM

(71) Applicant: Robert Sherwood, Almont, MI (US)

(72) Inventor: Robert Sherwood, Almont, MI (US)

( * ) Notice: Subject to any disclaimer, the term of this patent is extended or adjusted under 35 U.S.C. 154(b) by 189 days.

(21) Appl. No.: 17/225,719

(22) Filed: Apr. 8, 2021

(65) Prior Publication Data

US 2022/0325515 A1 Oct. 13, 2022

(51) Int. Cl.
*E03F 1/00* (2006.01)
*E04D 13/08* (2006.01)

(52) U.S. Cl.
CPC ..... *E03F 1/002* (2013.01); *E04D 13/08* (2013.01); *E04D 2013/0806* (2013.01)

(58) Field of Classification Search
CPC .... E03F 1/002; E03F 5/04; E04D 2013/0806; E04D 13/08
See application file for complete search history.

(56) References Cited

U.S. PATENT DOCUMENTS 1,541,436 A 6/1925 Reshan
2,003,770 A 6/1935 Goodhart
4,161,186 A * 7/1979 Sitarz ..... E04D 13/08 137/356
4,475,571 A 10/1984 Houston, Jr. et al.
4,850,059 A 7/1989 Dickerson
5,163,618 A * 11/1992 Cordua ..... B05B 15/16 239/107
5,864,990 A 2/1999 Tu
6,209,803 B1 * 4/2001 Colo'n ..... B05B 15/16 239/288.5
11,384,854 B1 * 7/2022 Rusch ..... F16K 21/04
2010/0206792 A1 8/2010 Stradley
2010/0322711 A1 12/2010 Frost
2011/0139694 A1 6/2011 Mondschein et al.
2015/0345125 A1 12/2015 Gazlay et al.
2017/0014846 A1 * 1/2017 Stathakos ..... B05B 15/16
2018/0080229 A1 3/2018 Kunz

* cited by examiner

*Primary Examiner* — Sean D Andrish
(74) *Attorney, Agent, or Firm* — Brooks Kushamn P.C.

(57) ABSTRACT

A water drainage system includes an underground conduit, a pop-up drain emitter, and a turf cover. The underground conduit is configured to direct water away from an eavestrough that is secured to a building. The pop-up drain emitter is secured to an end of the conduit and has a lid. The lid is configured to transition from a retracted position to an advanced position to emit water from the underground conduit. The lid is disposed above ground in at least the advanced position. The turf cover is disposed above and adjacent to the ground and radially about an outer periphery of the pop-up drain emitter. The turf cover is configured to inhibit vegetative growth radially about the outer periphery of the pop-up drain emitter.

20 Claims, 4 Drawing Sheets

TURF COVER FOR A WATER DRAINAGE SYSTEM

TECHNICAL FIELD

The present disclosure relates to water drainage systems, particularly to water drainage systems for buildings and houses.

BACKGROUND

Runoff water may be directed away from buildings and houses via water drainages systems.

SUMMARY

A water drainage system includes an underground conduit, a pop-up drain emitter, and a turf cover. The underground conduit is configured to direct water away from an eavestrough that is secured to a building. The pop-up drain emitter is secured to an end of the conduit and has a lid. The lid is configured to transition from a retracted position to an advanced position to emit water from the underground conduit. The lid is disposed above ground in at least the advanced position. The turf cover is disposed above and adjacent to the ground and radially about an outer periphery of the pop-up drain emitter. The turf cover is configured to inhibit vegetative growth radially about the outer periphery of the pop-up drain emitter.

A turf cover for a water drainage system includes an upper plate. The upper plate defines a central orifice configured to receive an end of a conduit that partially houses a pop-up drain emitter. A diameter of the central orifice is greater than an outer diameter of the conduit and less than an outer diameter of an outer rim of the pop-up drain emitter. The upper plate is configured to be disposed between the outer rim and the ground and to be disposed radially about the pop-up drain emitter to inhibit vegetative growth proximate to the pop-up drain emitter.

A water drainage system includes a pop-up drain emitter and a ring-shaped plate. The pop-up drain emitter includes a lid and an outer rim. The lid is configured to transition from a retracted position to an advanced position to emit water. An outer rim is disposed radially about the lid. The ring-shaped plate has an inner dimeter defining a central orifice and an outer diameter. The pop-up drain emitter is partially disposed within the central orifice. The ring-shaped plate is partially disposed below the outer rim and extends beyond an outer periphery of the outer rim. The ring-shaped plate is configured to engage the ground to inhibit vegetative growth radially about the outer periphery of outer rim.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
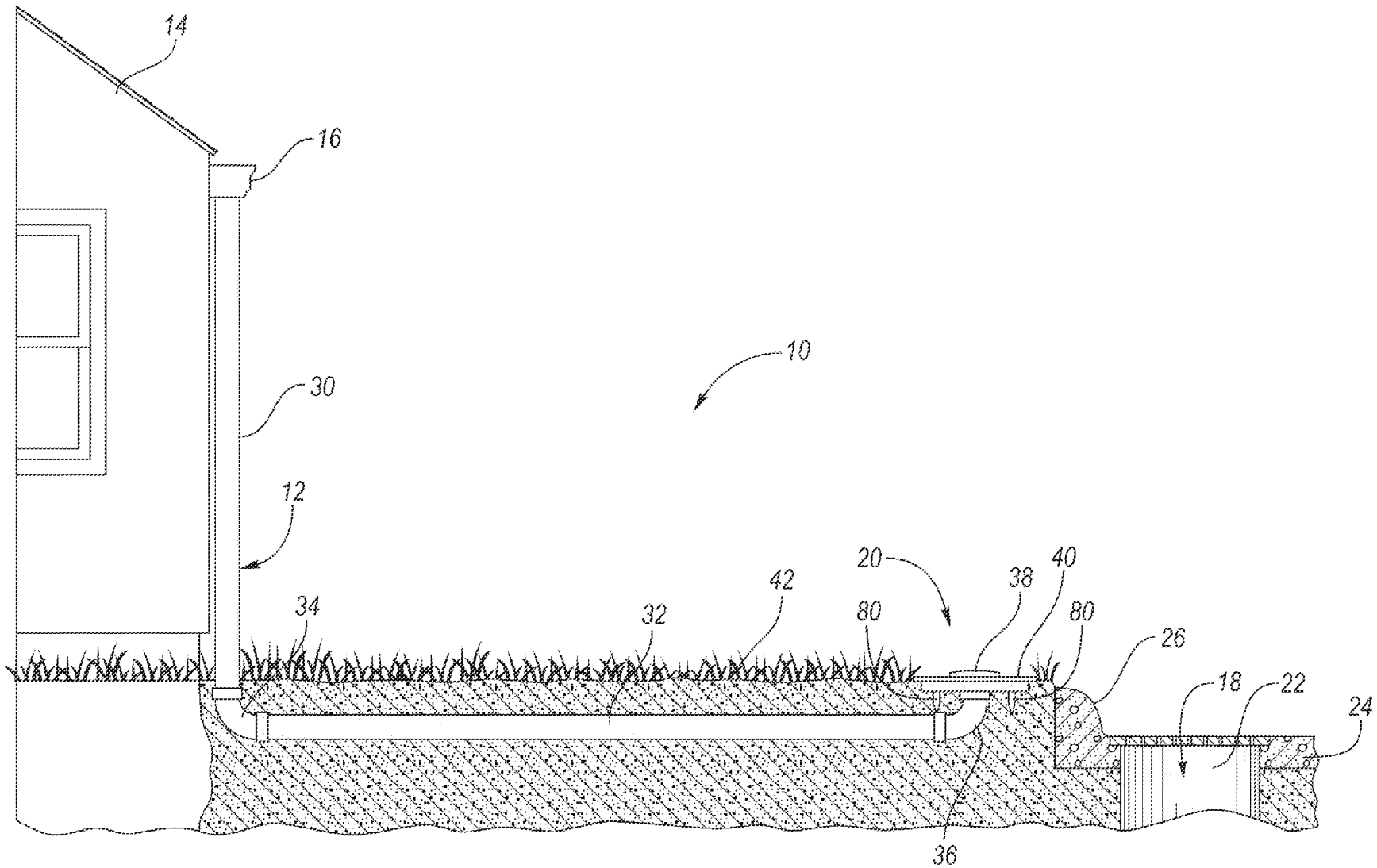
FIG. 1 is a front view of a water drainage systems for a building or house.

Referring to FIG. 1, a water drainage system 10 is illustrated. The water drainage system 10 may specifically be designed to direct water away from a house or building in order to prevent runoff water from the house or building from flooding the lower level (e.g., the basement) of the house or building. It should be understood, however, that the water drainage system 10 may be utilized in other scenarios and should not be construed as limited to a water drainage system that is configured to direct water away from a house or building.

As illustrated in FIG. 1, the water drainage system 10 includes tubes, pipes, or conduits 12 that are configured to direct water away from a house or building 14. More specifically, the conduits 12 may be configured to direct water away from an eavestrough 16 that is disposed along edges of a roof of the building 14. The eavestrough 16 is configured to collect runoff water that cascades down the roof of the building 14 during rainstorms, from melting snow, or from any other source. The conduits 12 are configured to direct the water away from the eavestrough 16 and away from the building 14. More specifically, the conduits 12 may be configured to direct the water toward a storm drain 18. Regulations may not allow a direct connection between a water drainage system 10 from a house or building 14 and a storm drain 18. Therefore, it is desirable to position an outlet end 20 of the water drainage system 10 in the vicinity of, but not directly connect to, the storm drain 18.

Catch basins 22 of storm drains 18 (i.e., the portions of storm drains that are the inlets to a storm drain system that are typically vertically oriented) are usually disposed along an edge of the pavement 24 of a road or street and adjacent to a curb 26 of the road or street. The pavement 24 typically has a slight slope to direct the runoff water from the road or street into the catch basin 22. The curb 26 is also positioned above the catch basin 22 and is sloped downward to direct runoff water from land that is adjacent to the catch basin 22 (herein after referred to as the adjacent land 28) toward the catch basin 22. Since a direct connected between the water drainage system 10 and the storm drain 18 may not be allowed, it may be desirable to position the outlet end 20 of the water drainage system 10 on or within the adjacent land 28, since the runoff water of the adjacent land will be directed toward the catch basin 22 of the storm drain 18.

The tubes, pipes, or conduits 12 of the water drainage system 10 may include a downspout 30 that is configured to direct water downward from the eavestrough 16 to a horizontal tube, pipe, or conduit 32. The horizontal conduit 32 in turn may be configured to direct water from the downspout 30 to the outlet end 20 of the water drainage system 10. The horizontal conduit 32 may include a slight downward slope extending in a direction from the downspout 30 to the outlet end 20 of the water drainage system 10 such that water flows from the downspout 30 to the outlet end 20 of the water drainage system 10. The downspout 30 may be connected to the horizontal conduit 32 via a first elbow tube, pipe, or conduit 34. The horizontal tube 32 and the first elbow conduit 34 may be disposed or buried underground, which may be for aesthetic purposes or may be to prevent placing an obstacle on an area of ground that may require maintenance (e.g., the area of ground may include grass that needs to be mowed on a regular basis) or that may have a significant amount of foot traffic. The outlet end 20 of the water drainage system 10 may include a second elbow tube, pipe, or conduit 36. The second elbow conduit 36 may also be disposed or buried underground. The second elbow conduit 36 may extend upward and toward an upper surface of the ground such that an end of the second elbow conduit 36 is approximately flush (i.e., exactly flush, slightly below, or slightly above) the upper surface of the ground.

A pop-up drain emitter 38 may be partially disposed within the end of the second elbow conduit 36 that is approximately flush with the upper surface of the ground. The pop-up drain emitter 38 may have a lid that is configured to transition between a retracted or closed position, where the lid is approximately flush or slightly above the upper surface of the ground and an advanced or opened position that is above the upper surface the ground. In the retracted or closed position, the lid is positioned to be below and out the way of any yard maintenance tools or machinery, particular the rotating blade of a lawnmower. In the advanced or opened position, the lid transitions away from an opening or orifice defined by the pop-up drain emitter 38 (the opening or orifice being in fluid communication with the second elbow conduit 36) such that water is able to flow out of opening or orifice defined by the pop-up drain emitter 38. In the retracted or closed position, the lid is configured to rest upon a seat defined by the pop-up drain emitter 38 such that the lid covers the opening or orifice defined by the pop-up drain emitter 38.

A turf cover 40 may be disposed radially about the pop-up drain emitter 38. The turf cover 40 may also be disposed above and adjacent to the upper surface of the ground. The turf cover 40 is configured to engage the ground to inhibit vegetative growth (e.g., grass 42) proximate to and radially about an outer periphery of the pop-up drain emitter 38. More specifically, the turf cover 40 may cover the ground such that sunlight is unable to penetrate the ground directly below the turf cover 40, which inhibits the vegetative growth. The pop-up drain emitter 38 and the turf cover 40 may both be green in order to blend in with the adjacent vegetation, or more specifically with the adjacent grass, which may be for aesthetic purposes.

Figure 5:
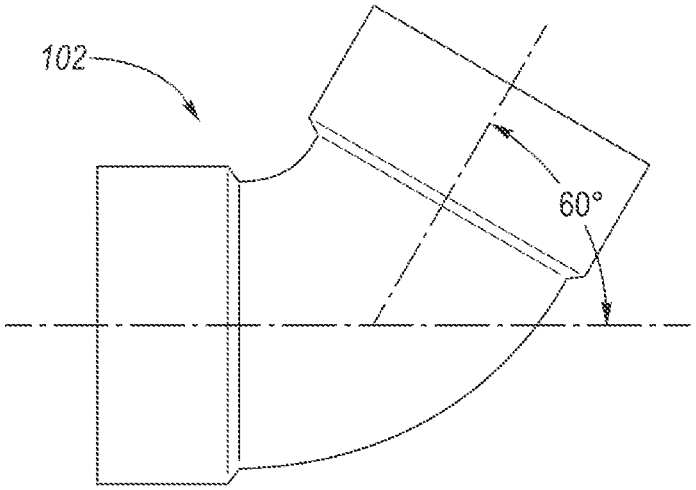
FIG. 5 is a 60° elbow pipe or conduit that may be utilized as a subcomponent of the water drainage system.
Figure 6:
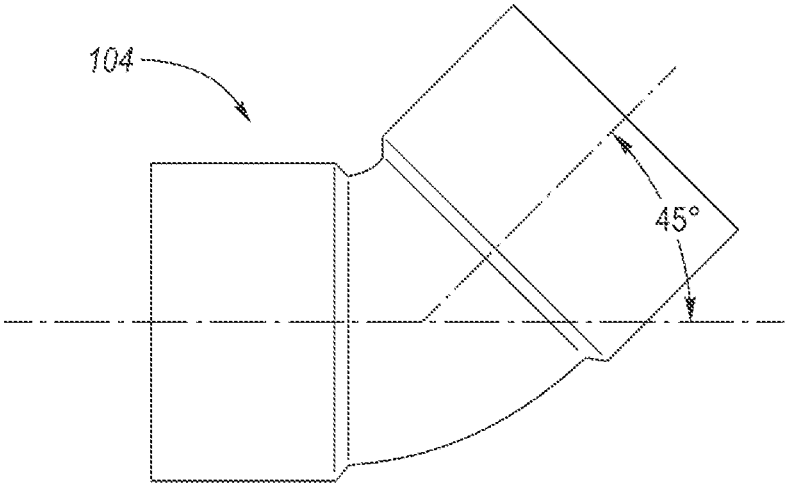
FIG. 6 is a 45° elbow pipe or conduit that may be utilized as a subcomponent of the water drainage system.
Figure 7:
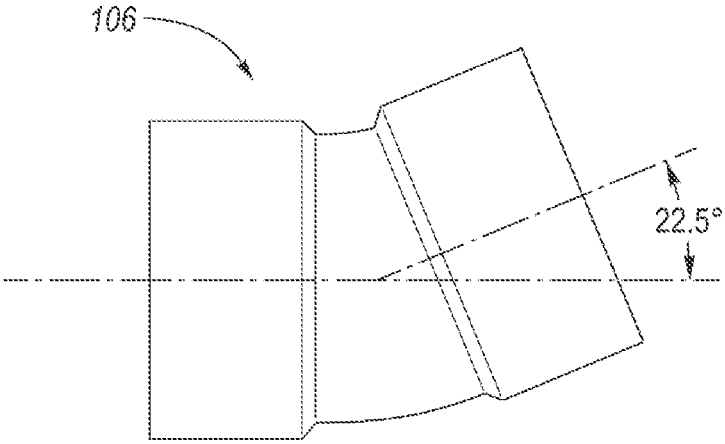
FIG. 7 is a 22.5° elbow pipe or conduit that may be utilized as a subcomponent of the water drainage system.

As previously stated, the conduits 12 may be configured to direct water away from any source, and this disclosure should not be construed as limited to the layout of conduits 12 in FIG. 1. For example, the first elbow conduit 34 and the second elbow conduit 36 are illustrated as 90° elbows (i.e., elbow pipes that turn at about a 90° angle), but may be reconfigured as elbows that turn at any desirable angle (See FIGS. 5, 6, and 7, which depict 60°, 45°, and 22.5° elbows, respectively, which may be referred to as elbow 102, elbow 104, and elbow 106, respectively, that may be utilized in place of the first elbow conduit 34 or the second elbow conduit 36). It may be desirable to reconfigure the second elbow conduit 36 as an elbow conduit that has a bend of less 90° (e.g., the elbows depicted in FIGS. 5, 6, and 7) in the event that ground at which the outlet end 20 of the water drainage system 10 is disposed has slope or grade that is not a flat 0° slope or grade.

Figure 2:
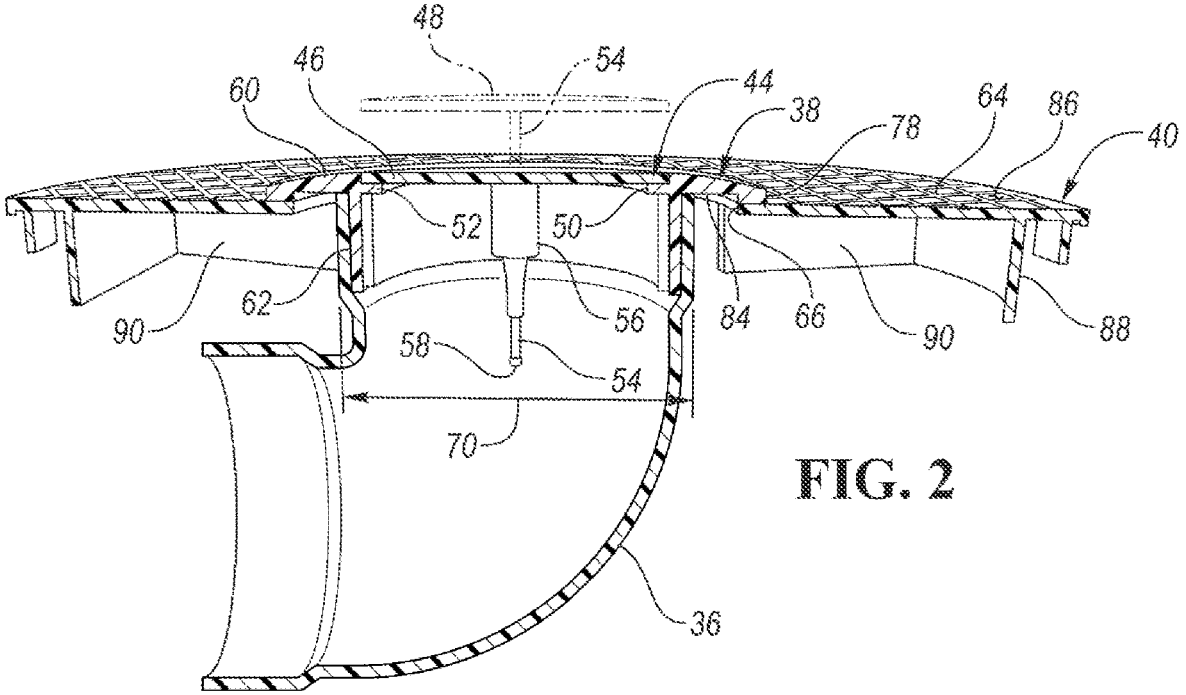
FIG. 2 is a cross-sectional view of an outlet portion of the water drainage system taken along line 2-2 in FIG. 3.
Figure 3:
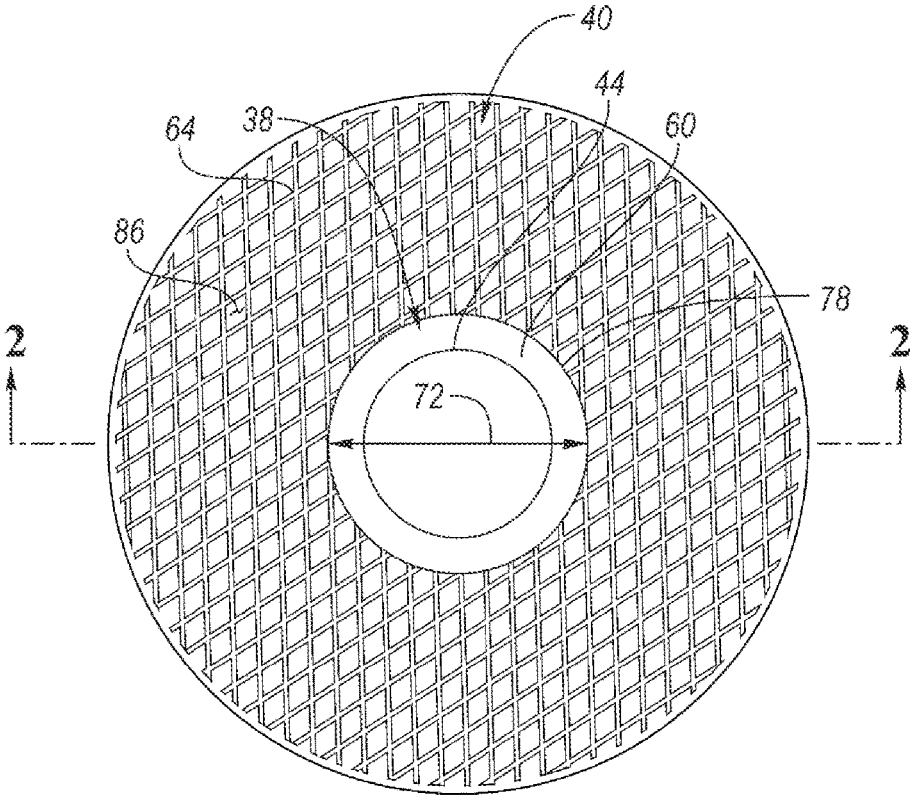
FIG. 3 is a top view of the outlet portion the water drainage system.
Figure 4:
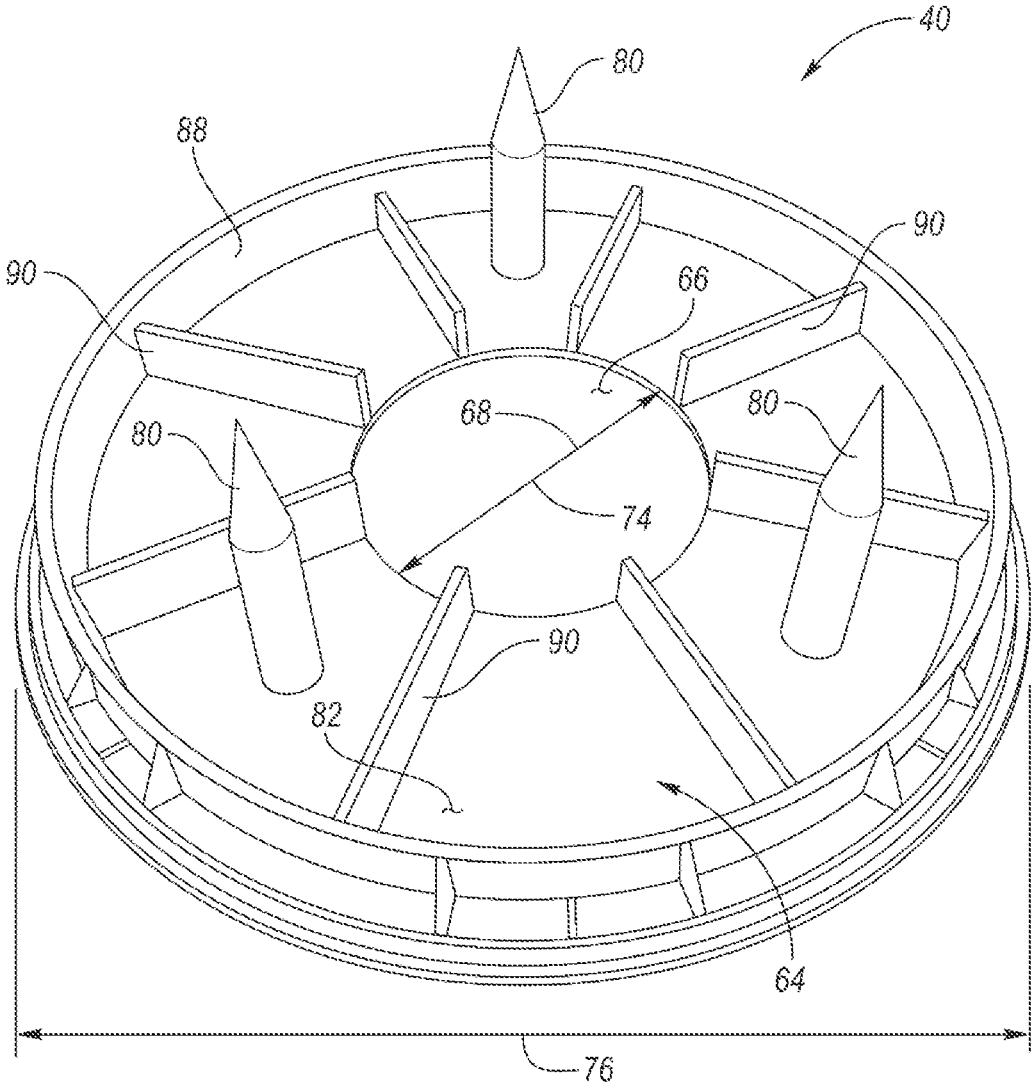
FIG. 4 is a bottom view of a turf cover that is a subcomponent of the water drainage system.

Referring now to FIGS. 2-4, the pop-up drain emitter 38 and the turf cover 40 are described in further detail. The turf cover 40 may also be referred to a restrictor plate or a turf restrictor plate. As previously stated, the pop-up drain emitter 38 includes a lid 44 that is configured to transition between a retracted or closed position 46 (where the lid 44 is approximately flush or slightly above the upper surface of the ground) and an advanced or opened position 48 that is above the upper surface the ground. In the advanced or opened position 48, the lid 44 transitions away from an opening or orifice 50 defined by the pop-up drain emitter 38 such that water is able to flow out of the opening or orifice 50 defined by the pop-up drain emitter 38. In the retracted or closed position 46, the lid 44 is configured to rest upon a seat 52 defined by the pop-up drain emitter 38 such that the lid 44 covers the opening or orifice 50 defined by the pop-up drain emitter 38.

The lid 44 may include an extension 54 that extends downward and through a tube 56 defined on the pop-up drain emitter 38. A knob 58 on the end of the extension 54 may be utilized to limit upward movement of the lid 44. The pop-up drain emitter 38 also includes an outer rim 60 that is disposed radially around or about the lid 44. The pop-up drain emitter 38 may be partially disposed within the end of the second elbow conduit 36. More specifically, the pop-up drain emitter 38 may include a mating portion or projection 62 that extends into the second elbow conduit 36. The out rim 60 may engage an end of the second elbow conduit 36 to limit how far the mating portion or projection 62 is able to extend into the second elbow conduit 36.

The turf cover 40 includes an upper plate 64 that defines a central orifice 66. The central orifice 66 is configured to receive an end of a conduit that partially houses the pop-up drain emitter 38 (e.g., the end of the second elbow conduit 36). The pop-up drain emitter 38 may be partially disposed within central orifice 66. More specifically, the mating portion or projection 62 of the pop-up drain emitter 38 that extends into the second elbow conduit 36 may be disposed within central orifice 66 within the end of the second elbow conduit 36. The diameter 68 of the central orifice 66 is greater than an outer diameter 70 of the conduit that partially houses the pop-up drain emitter 38 (e.g., the second elbow conduit 36). The diameter 68 of the central orifice 66 is less than an outer diameter 72 of the outer rim 60 of the pop-up drain emitter 38. The upper plate 64 is configured to be disposed between the outer rim 60 and the ground, to be disposed radially about the pop-up drain emitter 38, and to engage the ground to inhibit vegetative growth radially about an outer periphery of the pop-up drain emitter 38 and proximate to the pop-up drain emitter 38. More specifically, the upper plate 64 may cover the ground such that sunlight is unable to penetrate the ground directly below the upper plate 64, which inhibits the vegetative growth.

The upper plate 64 may more specifically, be a ring-shaped plate 64 having an inner diameter 74, which defines the central orifice 66, and an outer diameter 76. The upper plate 64 may be partially disposed below the outer rim 60 of the pop-up drain emitter 38. More specifically, a lower surface 84 of the outer rim 60 may overlap a portion of a top surface 86 of the upper plate 64 such that the portion of the top surface 86 is disposed below the lower surface 84 of the outer rim 60. The upper plate 64 may extend beyond an outer periphery 78 of the outer rim 60 of the pop-up drain emitter 38. The outer periphery 78 of the outer rim 60 of the pop-up drain emitter 38 may also be the outer periphery of the pop-up drain emitter 38 as a whole.

The turf cover 40 may be anchored to the ground via a plurality of stakes 80 extending into the ground. The plurality of stakes 80 may be integral to the turf cover 40 or may be separate components that extend through orifices defined by the turf cover 40. If the plurality of stakes 80 are integral to the turf cover, the plurality of stakes 80 may protrude downward from a bottom surface 82 of the upper plate 64. The plurality of stakes 80 may be substantially perpendicular to the upper plate 64. Substantially perpendicular may refer to any incremental value that ranges between exactly perpendicular and 15° from exactly perpendicular. Please note that the plurality of stakes 80 were excluded from FIG. 2 for illustrative purposes.

The turf cover 40 may also include a side plate 88. The side plate 88 may also protrude downward from the bottom surface 82 of the upper plate 64 and toward the ground. The side plate 88 may be substantially perpendicular to the upper plate 64. Substantially perpendicular may refer to any incremental value that ranges between exactly perpendicular and 15° from exactly perpendicular. The side plate 88 may also be ring-shaped and may form a closed loop around the central orifice 66 and the pop-up drain emitter 38. The side plate 88 may further prevent sunlight from penetrating below the turf cover 40, which further assists in inhibiting vegetative growth below the turf cover 40.

The turf cover 40 may also include ribs 90 that increase the structural integrity of the turf cover 40, which is desirable for occasions where the turf cover 40 may be required to support a load (e.g., someone stepping on the turf cover 40 or a lawnmower driving over the turf cover 40). The ribs 90 may extends along the bottom surface 82 of the upper plate 64 from the side plate 88 toward the central orifice 66 and the pop-up drain emitter 38. The top surface 86 of the upper plate 64 may be knurled in order to increase friction between the top surface 86 and an object that is contacting the top surface 86, such as the shoe of someone stepping on the top surface 86.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A water drainage system comprising:

an underground conduit configured to direct water away from an eavestrough that is secured to a building;

a pop-up drain emitter having (i) a mating portion secured to and disposed within an end of the conduit and (ii) a lid disposed within the mating portion and configured to transition from a retracted position to an advanced position relative to the mating portion to emit water from the underground conduit, wherein the mating portion has an outer rim protruding radially outward along a top of the mating portion and radially outward beyond the conduit, and wherein the lid is disposed above ground in at least the advanced position; and a turf cover disposed (i) above and adjacent to the ground, (ii) radially about outer peripheries of the mating portion and conduit, and (iii) below the outer rim such that the turf cover disposed between the outer rim and the ground, wherein the turf cover is configured to inhibit vegetative growth radially about the outer peripheries of the mating portion and conduit.

2. The water drainage system of claim 1, wherein the turf cover is anchored to the ground via a plurality of stakes extending into the ground.

3. The water drainage system of claim 2, wherein the plurality of stakes is integral to the turf cover.

4. The water drainage system of claim 1, wherein the outer rim is disposed radially about the lid.

5. The water drainage system of claim 1, wherein the turf cover includes an upper plate and a side plate that protrudes downward from a bottom surface of the upper plate and toward the ground.

6. The water drainage system of claim 5, wherein the side plate forms a closed loop that extends about the outer peripheries of the mating portion and conduit.

7. The water drainage system of claim 5, wherein turf cover includes ribs that extend from the side plate toward the outer peripheries of the mating portion and conduit.

8. The water drainage system of claim 5, wherein a top surface of the upper plate is knurled.

9. A turf cover for a water drainage system comprising:

an upper plate defining a central orifice configured to receive an end of a conduit that partially houses a pop-up drain emitter, the pop-up emitter having a mating portion secured to the conduit, a lid that is movable relative to the mating portion and conduit, and an outer rim that is integral to the mating portion, wherein (i) a diameter of the central orifice is greater than outer diameter outer diameters of the conduit and mating portion and is less than an outer diameter of the outer rim, and (ii) the upper plate is configured to be disposed between the outer rim and the ground and to be disposed radially about the mating portion and conduit to inhibit vegetative growth proximate to the pop-up drain emitter.

10. The turf cover of claim 9 further comprising a side plate protruding downward from a bottom surface of the upper plate, wherein the side plate forms a closed loop that extends about the central orifice, and about the outer diameters of the conduit and mating portion.

11. The turf cover of claim 10, wherein the side plate is substantially perpendicular to the upper plate.

12. The turf cover of claim 10 further comprising ribs that extend from the side plate toward the central orifice.

13. The turf cover of claim 9 further comprising a plurality of stakes protruding downward from a bottom surface of the upper plate, wherein the plurality of stakes is configured to anchor the turf cover to the ground.

14. The turf cover of claim 13, wherein the plurality of stakes is substantially perpendicular to the upper plate.

15. The turf cover of claim 9, wherein a top surface of the upper plate is knurled.

16. A water drainage system comprising:

a pop-up drain emitter having (i) a mating portion secured to and disposed within a conduit, (ii) a lid configured to transition from a retracted position to an advanced position relative to the mating portion to emit water, and (iii) an outer rim integral to the mating portion, disposed radially about the lid, and extending radially outward from the conduit along a top of the conduit; and a ring-shaped plate having an inner dimeter defining a central orifice and an outer diameter, wherein (i) the mating portion and conduit are partially disposed within the central orifice, (ii) the ring-shaped plate is partially disposed below the outer rim, between the outer rim and the ground, and extends beyond an outer periphery of the outer rim, and (iii) the ring-shaped plate is configured to engage the ground to inhibit vegetative growth radially about the outer periphery of outer rim.

17. The water drainage system of claim 16 further comprising a side plate protruding downward from a bottom surface of the ring-shaped plate, wherein the side plate forms a closed loop that extends about the central orifice, and about the conduit and mating portion.

18. The water drainage system of claim 17 further comprising ribs that extend from the side plate toward the central orifice.

19. The water drainage system of claim 16 further comprising a plurality of stakes protruding downward from a bottom surface of the ring-shaped plate, wherein the plurality of stakes is configured to anchor the ring-shaped plate to the ground.

20. The water drainage system of claim 16, wherein a top surface of the ring-shaped plate is knurled.

* * * * *